US008310173B2

(12) United States Patent
Katakame

(10) Patent No.: US 8,310,173 B2
(45) Date of Patent: Nov. 13, 2012

(54) LED DRIVING DEVICE, ILLUMINATING DEVICE, AND DISPLAY DEVICE

(75) Inventor: Hirokazu Katakame, Otawara (JP)

(73) Assignee: Sharp Kabushiki Kaisha, Osaka (JP)

( * ) Notice: Subject to any disclaimer, the term of this patent is extended or adjusted under 35 U.S.C. 154(b) by 317 days.

(21) Appl. No.: 12/446,040

(22) PCT Filed: Oct. 18, 2007

(86) PCT No.: PCT/JP2007/070338

§ 371 (c)(1),
(2), (4) Date: Apr. 17, 2009

(87) PCT Pub. No.: WO2008/047862

PCT Pub. Date: Apr. 24, 2008

(65) Prior Publication Data

US 2010/0295466 A1 Nov. 25, 2010

(30) Foreign Application Priority Data

Oct. 19, 2006 (JP) ..... 2006-285323

(51) Int. Cl.
*H05B 37/02* (2006.01)

(52) U.S. Cl. ..... 315/291; 315/209 R; 315/312

(58) Field of Classification Search ..... 315/72, 315/172, 186, 193, 209 R, 211, 217, 219, 315/291, 294–295, 311, 313–315, 362
See application file for complete search history.

(56) References Cited

U.S. PATENT DOCUMENTS 5,767,828 A 6/1998 McKnight
5,812,303 A 9/1998 Hewlett et al.
6,570,550 B1 5/2003 Handschy et al.
6,995,519 B2 * 2/2006 Arnold et al. ..... 315/169.3
7,122,973 B1 * 10/2006 Ivers ..... 315/291
2004/0119451 A1 6/2004 Otake
2004/0183380 A1 9/2004 Otake
2004/0195983 A1 10/2004 Toyota et al.
2004/0196225 A1 * 10/2004 Shimada ..... 345/82
2005/0116922 A1 6/2005 Kim
2005/0179629 A1 8/2005 Inoue
(Continued)

FOREIGN PATENT DOCUMENTS

JP 2001-313423 A 11/2001
(Continued)

OTHER PUBLICATIONS

Extended European Search Report in European Application No. 07830072.0 mailed Mar. 22, 2011.
(Continued)

*Primary Examiner* — Jason M Crawford
(74) *Attorney, Agent, or Firm* — Birch, Stewart, Kolasch & Birch, LLP

(57) ABSTRACT

Provided is an LED driving device which can stably reduce brightness of an LED. The LED driving device provided with: a driving voltage switching means (Q1008) for switching between a first driving voltage and a second driving voltage in accordance with a timing signal; and feedback circuits (Q1001 to Q1005) to which any one of the first and second driving voltages is applied and which thereby determine a current flowing through an LED. The feedback circuits are provided with a resistor switching means (Q2001) for switching, in accordance with the timing signal, between resistors (R1001, R1002, and R2001) that determine the current flowing through the LED.

9 Claims, 10 Drawing Sheets

U.S. PATENT DOCUMENTS

2005/0200315 A1* 9/2005 Kwong et al. ..... 315/308

FOREIGN PATENT DOCUMENTS

JP 2002-203988 A 7/2002
JP 2004-194448 A 7/2004
JP 2004-274872 A 9/2004
JP 2004-299102 A 10/2004
JP 2004-311635 A 11/2004
JP 2005-5112 A 1/2005
JP 2005-142137 A 6/2005

OTHER PUBLICATIONS

Sedra et al., "Microelectronic Circuits," 3.3 Modeling the Diode Forward Characteristic—Chapter 3 Diodes, 2004, XP002626743, pp. 153-154.

* cited by examiner

LED DRIVING DEVICE, ILLUMINATING DEVICE, AND DISPLAY DEVICE

This application is a national stage application under 35 U.S.C. §371 of International Application No. PCT/JP2007/070338 filed on Oct. 18, 2007, which claims priority to Japanese Application No. 2006-285323 filed on Oct. 19, 2006, incorporated herein by reference.

BACKGROUND OF THE INVENTION

1. Field of the Invention

The present invention relates to an LED (Light Emitting Diode) driving device, an illuminating device using an LED as its light source, and a projection-type display device.

2. Description of the Related Art

A field-sequential display device is an example of projection-type display devices, and forms a color image by time-divisionally displaying R (red), G (green), B (blue). The formation of a color image in an exemplar DLP (Digital Light Processing) projector is performed by: employing a high-pressure mercury lamp or the like as a light source; separating the white light from the light source into colors by means of a color wheel; modulating the color-separated light by means of a reflective device such as a DMD (Digital Micromirror Device); and then projecting the modulated light on a screen through a projection optical system.

The quantization noise causes a problem in low-intensity display of the brightness expression implemented by a display device with such a reflective device. To address this problem, a conventional display device employing a lamp such as a high-pressure mercury lamp is equipped with an ND (Neutral Density) filter attached to the segments of the color wheel. The ND filter is designed to lower the intensity down to approximately 10% so that the apparent bits in low-intensity display can be increased and thus the quantization noise can be reduced.

Another example of field-sequential display devices employs LEDs of RGB colors as light sources in place of a white-lamp light source with a color wheel. The RGB LEDs emit light in a time-dividing manner, and the light thus emitted enters a reflective device to be modulated. The resultant light is then projected on a screen through a projection optical system to form a color image. Note that, in this case, the light emission for each LED is turned on and off by pulsing.

Meanwhile, liquid-crystal displays are examples of direct-view display devices. The light source of the liquid-crystal display has come to employ solid-state illumination (i.e., LEDs) in place of fluorescent tubes. An improvement in the performance of the liquid-crystal display has been achieved by a technique (known as an area-active technique). In the technique, the intensities of the multiple LEDs that the liquid-crystal display device is equipped with are changed for such groups of LEDs as determined in accordance with the video image to be displayed by the liquid-crystal display device. The visual dynamic range is thus changed resulting in the above-mentioned improvement in the performance.

[Patent Document 1] JP-A-2001-313423
[Patent Document 2] JP-A-2002-203988
[Patent Document 3] JP-A-2004-274872
[Patent Document 4] JP-A-2005-142137

SUMMARY OF THE INVENTION

Problems to be Solved by the Invention

The display device equipped with LED light source also has the problem of quantization noise at low-intensity display. Being provided with no color wheel, the kind of countermeasures such as the ND filter employed in the conventional display device with the lamp light source cannot be taken in the case of the display device with the LED light source.

The same effect as that obtainable by use of the ND filter can be obtained by reducing the amount of the light emitted from each LED. The reduction in the light-emitting amounts of the LEDs can be achieved, for example, by pulse-based light modulation. The light emission of each LED, however, is controlled by pulsing in a field-sequential display device, so that the pulse-based light modulation is not operable.

Reducing the current that flows through the LEDs is another way of achieving the reduction in the amount of light emitted from each LED. In the light modulation by changing the amount of current, lowering the power is a problem. The detected current is converted to a voltage and the resultant voltage is used for feedback in this type of modulation. A small current, however, results in a small feedback voltage, which makes the light modulation control difficult.

Patent Document 1 discloses a light-emitting diode driving device that employs a technique based on a switching circuit. The disclosed device employs a current-detection method based on the control using a single resistor, and cannot deal with a minute current. In addition, the configuration of the circuit may have a problem caused by the offset in the comparator.

Patent Document 2 discloses a light-emitting element driving circuit that is configured to improve the efficiency by means of peak-value detection. The disclosed circuit, however, is not suitable for constant current regulation from a large current to a minute current.

Patent Document 3 also discloses a light-emitting diode driving device that employs a technique based on a switching circuit. The disclosed device employs a current-detection method based on the control using a single resistor, and cannot deal with a minute current. In addition, the configuration of the circuit may have a problem caused by the offset in the comparator.

Patent Document 4 discloses a light-emitting diode driving device that employs a light modulation method based on switching, and thus cannot be used in the field-sequential display device. In addition, the switching makes the influence of the noise more likely to be produced.

In view of what has been described thus far, the present invention provides an LED driving device with the following features. The LED driving device, if employed in a projection-type display device, is capable of stably reducing the brightness of the LEDs down to such a level that the same effect as in a case of using the ND filter can be obtained. The LED driving device, if employed in a direct-view type display device, is capable of driving the display device by the area-active technique based not on the pulse-based light modulation control but on the current-based light modulation control. The present invention also provides an illuminating device and a display device each of which employs the LED light source with the above-mentioned features and which thereby reduces the generation of the noise.

Means for Solving the Problems

The present invention provides an LED driving device including: a driving voltage switching means for switching between a first driving voltage and a second driving voltage in accordance with a timing signal; and a feedback circuit to which any one of the first and second driving voltages is applied and which thereby determines a current flowing through an LED. The feedback circuit includes a current controlling means for controlling, in accordance with the timing signal, a current flowing through the LED.

The current controlling means may be a resistor switching means for switching, in accordance with the timing signal, between opposings that determine the current flowing through the LED.

The present invention provides an illuminating device including: an LED driving device such as one described above; and an LED driven by the LED driving device.

The present invention provides a display device including: an LED driving device such as one described above; a green LED driven by the LED driving device; a red LED; a blue LED; a controlling means for switching between the green LED, the red LED, and the blue LED and making the selected one of the LEDs emit light; a reflective device which is controlled by the controlling means in synchronization with the light emission of the green LED, the red LED, and the blue LED, and which modulates the light emitted by the green LED, the red LED, and the blue RGB; and a projection optical system which projects light reflected by the reflective device.

In addition, the present invention provides a direct-view type display device including an LED driving device such as one described above; and a backlighting system that can achieve an area-active control and a wide dynamic range. The area-active control and the wide dynamic range are made possible not by means of an ON/OFF pulse modulation of light of the green LED, the red LED, and the blue LED all of which are driven by the LED driving device but by means of a current modulation of light of the LEDs, that is, by changing the driving currents for the LEDs.

Effects of the Invention

What is obtained according to the present invention is an LED driving device is capable of stably reducing the brightness of the LEDs down to such a level that the same effect as in a case of using an ND filter can be obtained.

DESCRIPTION OF SYMBOLS

Figure 1:
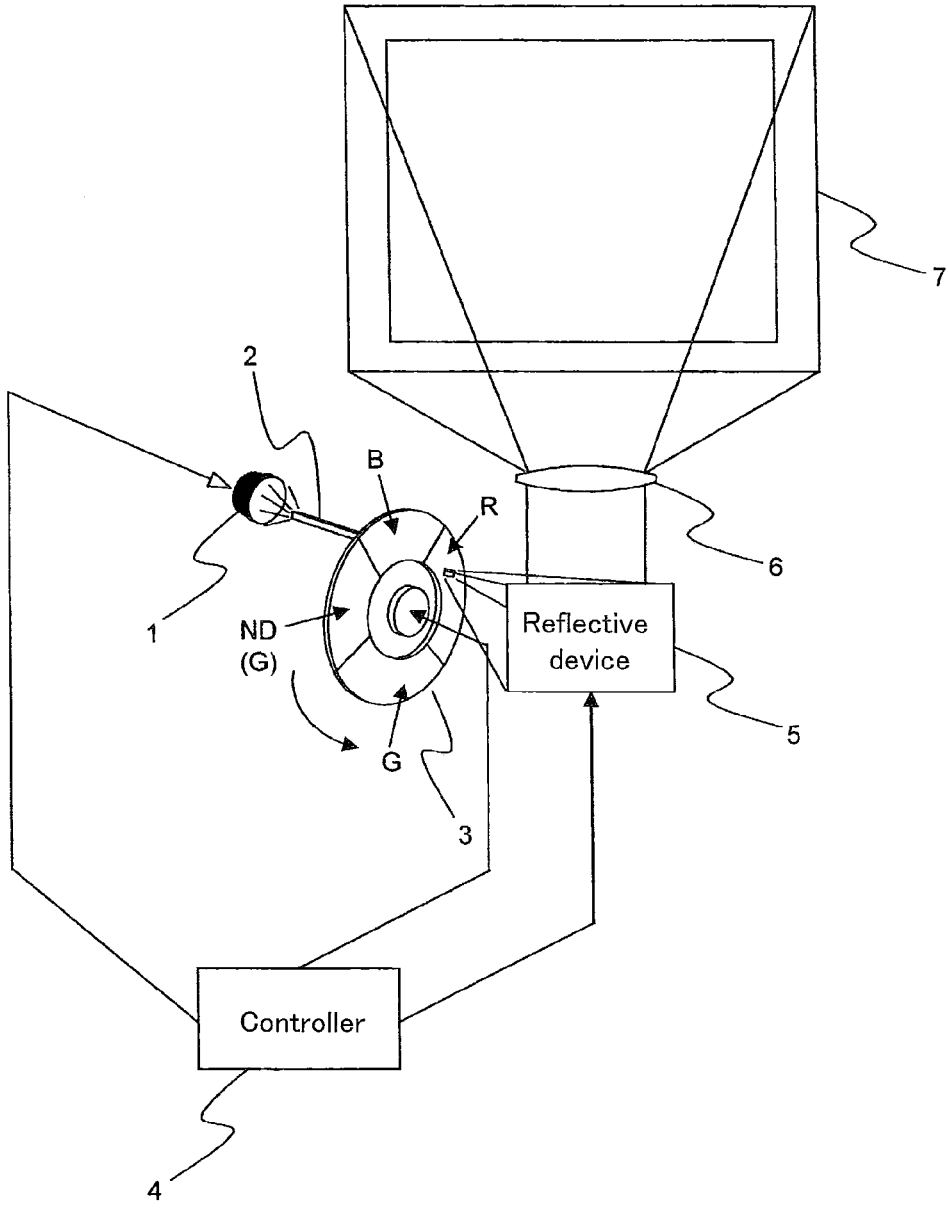
FIG. 1 is a diagram illustrating the configuration of a DLP system equipped with a color wheel.

1 light source
2 light pipe
3, 12 color wheel
4, 13 controller
5, 14 reflective device
6, 15 projector lens
7, 16 projection screen
11 LED light source
Q1001 to Q1010, Q2001 transistor
R1001 to R1015, R2001 resistor

DETAILED DESCRIPTION OF THE INVENTION

FIG. 1 is a block diagram illustrating the configuration of a field-sequential DLP system equipped with a conventional light source of a high-pressure mercury lamp. A light source 1 is a high-pressure mercury lamp. This system includes a color wheel 3 that includes segments of R (red), G (green), B (blue), and ND (grey). The segment of ND may be a segment of deep green. The light emitted from the light source 1 is led to the color wheel 3 through a light pipe 2 and then passes through each segment of the color wheel 3, so that light beams of R, G, B, and ND are produced in a time-dividing manner. The resultant light beams of R, G, B, and ND are reflected by a reflective device 5, such as a DMD, which is controlled by a controller 4 in synchronization with the rotation of the color wheel 3. The light beams thus reflected then pass through a projector lens 6 and are then projected onto a projection screen 7. Thereby an image is produced.

Figure 2:
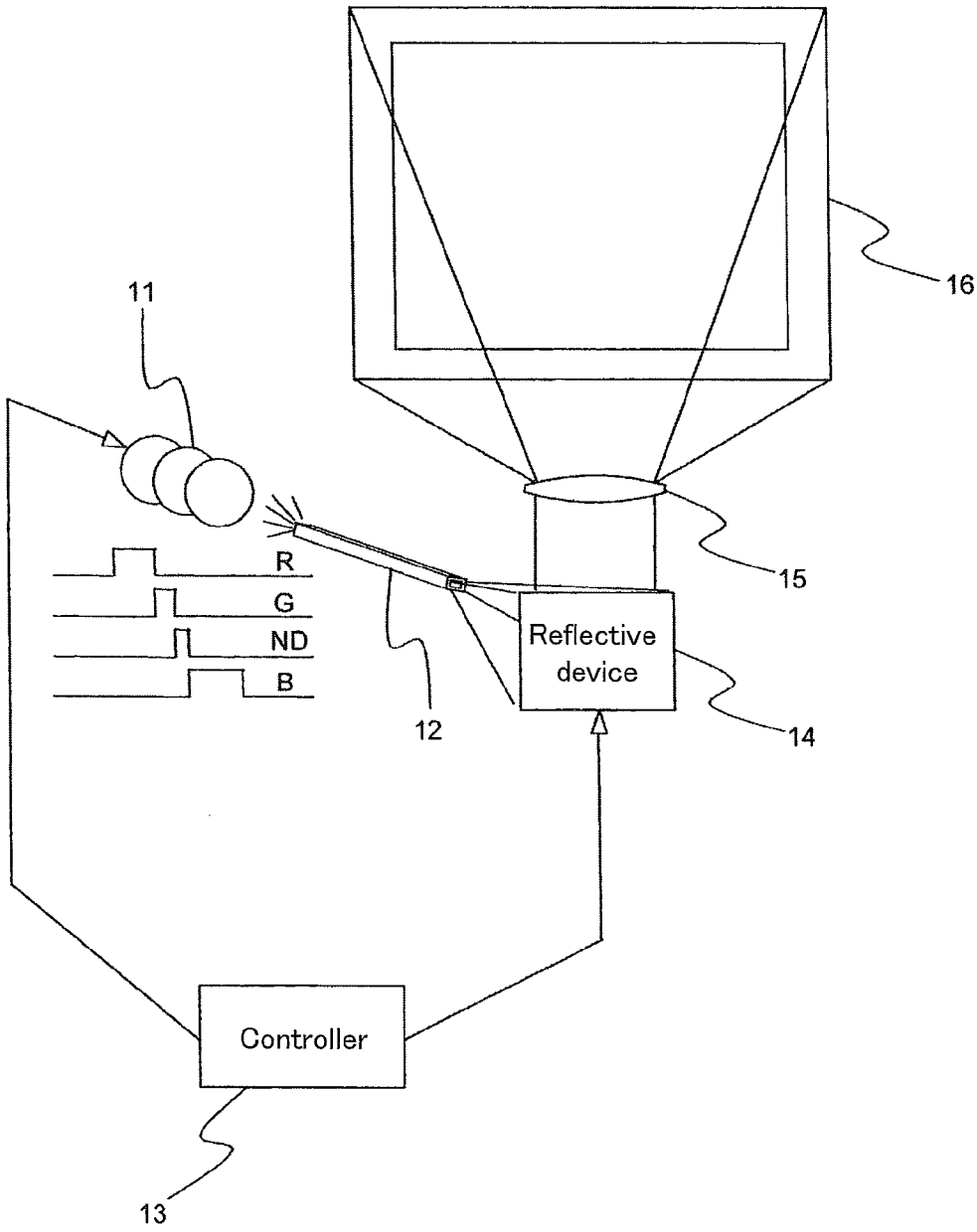
FIG. 2 is a diagram illustrating the configuration of a DLP system equipped with an LED light source.

FIG. 2 is a block diagram illustrating the configuration of a field-sequential DLP system equipped with a LED light source 11. The light emitted from a light source 1 including LEDs having colors of R, G, and B are led, through a light pipe 12, to a reflective device 14, such as a DMD, which is controlled by a controller 13 in synchronization with the light emission of each of the RGB colors of the LEDs. The light is then reflected by the reflective device 14. The resultant light then passes through a projector lens 15, and then is projected onto a projection screen 16. Thereby, an image is produced.

Figure 3:
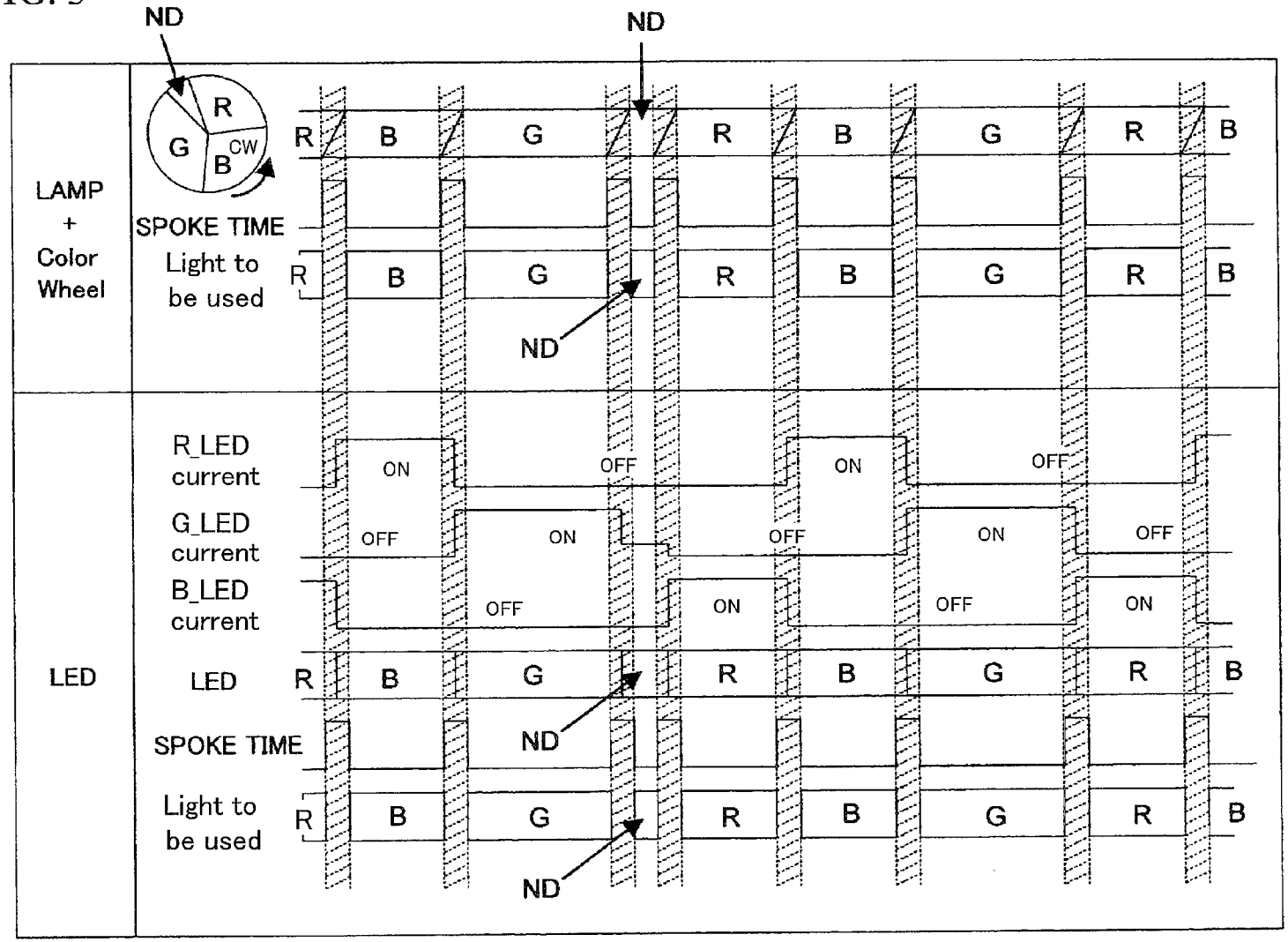
FIG. 3 is a chart comparing the timing at which the light of each color is emitted by the DPL system equipped with a color wheel and the timing at which the light of each color is emitted by a DLP system equipped with an LED light source.

The DLP system equipped with the LED light source and shown in FIG. 2 can have the same effect as in the case of using ND in the DLP system equipped with the color wheel and shown in FIG. 1. This is achieved by a reduction in the amount of light emitted by the LEDs, which is achieved by a reduction in the current flowing through the LEDs. FIG. 3 shows a comparison between the timings at which light of each color is emitted in the DLP system equipped with the color wheel and the corresponding timings in the DLP system equipped with the LED light source. The light of ND is produced by employing a deep-green ND segment in the DLP system with the color wheel whereas the DLP system with the LED light source reduces the amount of light emitted from the G (green) LED to produce the ND light.

Figure 4:
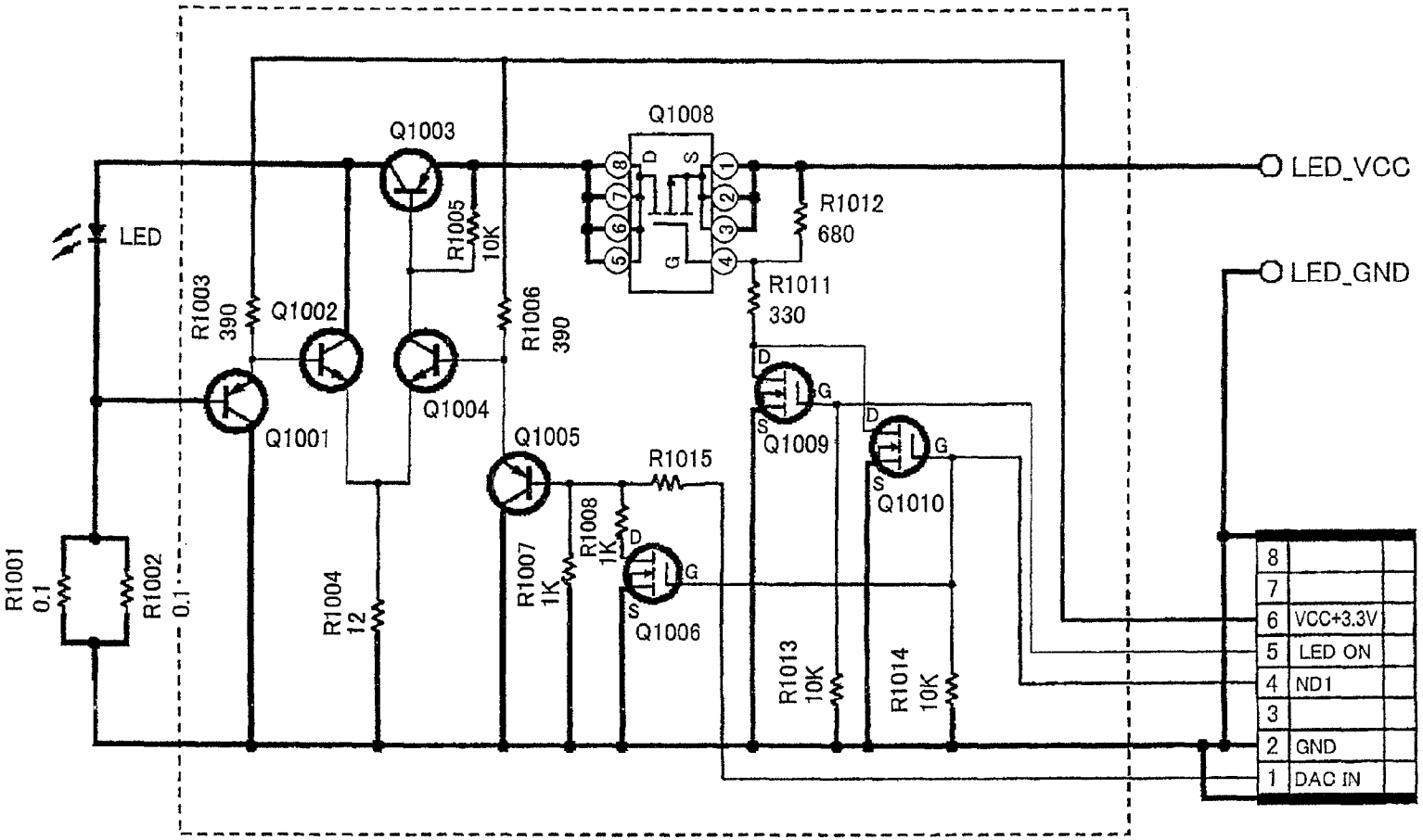
PRIOR ART FIG. 4
FIG. 4 is a circuit diagram illustrating a conventional LED driving circuit.

FIG. 4 is a diagram illustrating a circuit of a conventional LED driving device. The LED driving device can switch the current flowing through each of the LEDs between two different levels, and can thereby change the amount of light emitted from each LED between two different levels. This function is used for switching between the normal light emission of the green LED, which is the emission of normal green light, and the ND light emission, that is, when the green LED is used to function as the ND.

Reference numerals R1001 to R1015 denote resistors, and reference numerals Q1001 to Q1010 denote transistors. LED_ VCC shown in the upper right-hand portion of FIG. 4 denotes a power source to drive the LEDs with a large electric power. LED_GND denotes a ground for the power source. Connectors connected to a microcomputer and to a DAC are shown in the lower right-hand portion of FIG. 4. VCC+3.3V denotes a 3.3−V power source for a control circuit. LED ON denotes a timing pulse which is supplied by the DAC and which makes the LEDs emit normal light. When this signal is high, the LEDs emit normal light. ND1 denotes a timing pulse which is supplied by the DAC and which makes the LEDs emit ND light. When this signal is high, the LEDs emit ND light. GND denotes a reference ground of the circuit. DAC IN denotes a potential which takes a fixed value set (adjusted) basically within the 256 different levels ranging from the GND level to the VCC level. Changing this value of potential allows the current flowing through the LEDs to be changed.

The portion enclosed by the dotted lines in FIG. 4 is a regulator unit. The LED driving device shown in FIG. 4 employs a series-regulator configuration. Nonetheless, even with a switching-regulator configuration, the concept with respect to the feedback is still the same.

The driving voltage for the LEDs denoted by the LED ON passes through an and-circuit including transistors Q1009 and Q1010 into which the LED-ON and the ND supplied by the DAC, and then is switched by the transistor Q1008. The transistor Q1003 is provided for the regulation of the driving voltage thus switched.

In the LED driving device shown in FIG. 4, the transistors Q1002 and Q1004 constitute a differential circuit. The transistors Q1001 and Q1005 constitute an interface circuit for inputting a signal to the differential circuit. The current having flowed through the LEDs flows through a resistor network including the resistors R1001 and R1002. When the current having flowed through the LEDs flows through the resistor network, a voltage is generated between the GND of the resistor network and the cathodes of the LEDs. The voltage thus generated passes through the transistor Q1001 and returns to the transistor Q1002. The differential circuit including the transistors Q1002 and Q1004 controls the base current of the transistor Q1003 so that the voltage applied to the base of the transistor Q1004 can be the same as the base voltage of the transistor Q1002. Accordingly, the potential applied to the resistor network including the resistors R1001 and R1002 is fixed to a certain value, so that the fixed value of the current flowing through the resistor network can be determined uniquely. As a consequence, the current flowing through the LEDs is made constant.

The control of a minute current, however, is difficult by use of the above-described system which controls the current in a feedback route in which a current-voltage conversion is performed. Even when the base potential of the transistor Q1005 is set to zero, the occurrence of a dark current (leakage current) prevents the transistor Q1001 from having a zero base voltage. In this case, it is difficult to reduce the light amount down to approximately 10%, which can be easily done by use of the ND filter.

Figure 5:
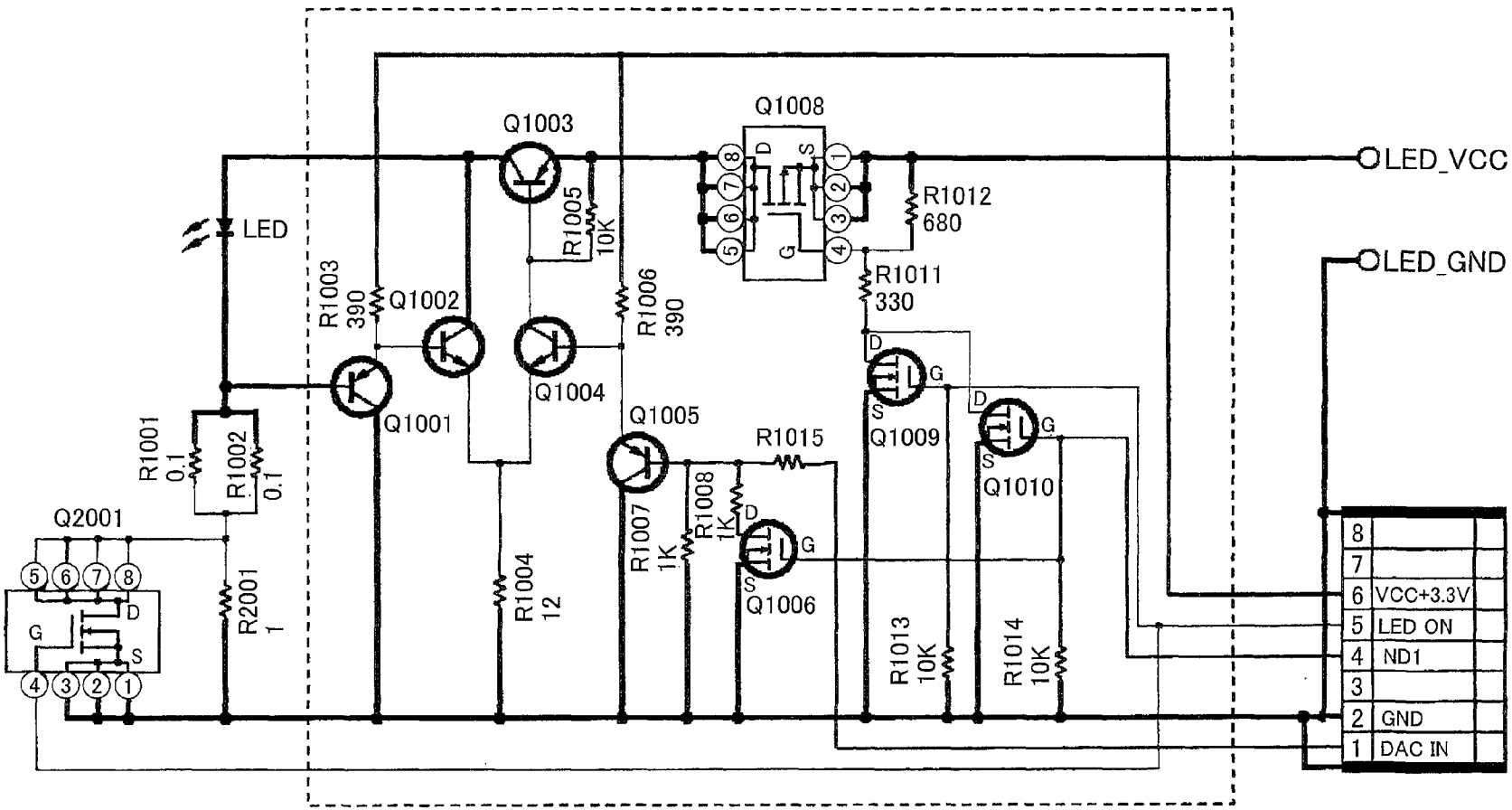
FIG. 5 is a circuit diagram illustrating an LED driving circuit of the present invention (for a projection-type display device).

FIG. 5 is a diagram illustrating a circuit of the LED driving device of the present invention. Reference numerals R1001 to R1015, and R2001 denote resistors. Reference numerals Q1001 to Q1010, and Q2001 denote transistors. LED_VCC shown in the upper right-hand portion of FIG. 5 denotes a power source to drive the LEDs with a large electric power. LED_GND denotes a ground for the power source. Connectors connected to a microcomputer and to a DAC are shown in the lower right-hand portion of FIG. 5. VCC+3.3V denotes a 3.3−V power source for a control circuit. LED ON denotes a timing pulse which is supplied by the DAC and which makes the LEDs emit normal light. When this signal is high, the LEDs emit normal light. ND1 denotes a timing pulse which is supplied by the DAC and which makes the LEDs emit ND light. When this signal is high, the LEDs emit ND light. GND denotes a reference ground of the circuit. DAC IN denotes a potential which takes a fixed value set (adjusted) basically within the 256 different levels ranging from the GND level to the VCC level. Changing this value of potential allows the current flowing through the LEDs to be changed.

The portion enclosed by the dotted lines in FIG. 5 is a regulator unit. The LED driving device shown in FIG. 5 also employs a series-regulator configuration. Nonetheless, even with a switching-regulator configuration, the concept with respect to the feedback is still the same.

The driving voltage for the LEDs denoted by the LED ON passes through an and-circuit including transistors Q1009 and Q1010 into which the LED-ON and the ND supplied by the DAC, and then is switched by the transistor Q1008. The transistor Q1003 is provided for the regulation of the driving voltage thus switched.

In the LED driving device shown in FIG. 5, the transistors Q1002 and Q1004 constitute a differential circuit. The transistors Q1001 and Q1005 constitute an interface circuit for inputting a signal into the differential circuit. The current having flowed through the LEDs flows through a resistor network including the resistors R1001, R1002, and R2001. When the current having flowed through the LEDs flows through the resistor network, a voltage is generated between the GND of the resistor network and the cathodes of the LEDs. The voltage thus generated passes through the transistor Q1001 and returns to the transistor Q1002. The differential circuit including the transistors Q1002 and Q1004 controls the base current of the transistor Q1003 so that the voltage applied to the base of the transistor Q1004 can be the same as the base voltage of the transistor Q1002. Accordingly, the potential applied to the resistor network is fixed to a certain value, so that the fixed value of the current flowing through the resistor network can be determined uniquely. As a consequence, the current flowing through the LEDs is made constant.

The control of a minute current, however, is difficult by use of the above-described system which controls the current in a feedback route in which a current-voltage conversion is performed. Even when the base potential of the transistor Q1005 is set to zero, the occurrence of a dark current (leakage current) prevents the transistor Q1001 from having a zero base voltage.

As will be described below, in the LED driving device of the present invention shown in FIG. 5, the value of the current flowing through the feedback route is switched by the transistor Q2001 in accordance with the driving current of the LEDs so that the driving current is reduced except for the case of the emission of the normal light. What is made possible with this configuration is the controlling of a minute current, which is not possible with the conventional feedback configuration as shown in FIG. 4.

The gate of the transistor Q2001 is controlled by the LED ON. When the LEDs emit the normal light, that is, when the LED ON is high, the transistor Q2001 is in operation and, in the circuit, the resistor 82001 is made to be equivalent to the ground. Accordingly, in this case, the current flowing through the LEDs is determined by the value of the combined resistor including the two resistors R1001 and R1002.

When the LEDs emit the ND light, that is, when the LED ON is low, the transistor Q2001 is not in operation, so that the circuit as a whole becomes equivalent to a circuit without the Q2001. Accordingly, in this case, the current flowing through the LEDs is determined by the value of the combined resistor including the three resistors R1001, R1002, and R2001.

As has been described above, in the LED driving device of the present invention, the current is controlled by switching the voltage supplied from the DAC, and the value of the current is switched by the feedback route. Accordingly, a minute current can be controlled. The use of the LED driving device of the present invention in a display device can result in the effect obtainable by use of the ND filter in a conventional system equipped with a color wheel. As a consequence, a video image can be formed with a reduced quantization noise.

In the above-described embodiment, a case where green LEDs are driven to emit normal light and ND light has been described using an example of a field-sequential DLP system equipped with a light source of LEDs. The present invention, however, is not limited to the above-described embodiment, but is applicable to other uses. For example, the present invention can be carried out as an illuminating device equipped with a light source of LED and a device enabling the adjustment of the amount of light.

The LED driving device of the present invention is applicable to an area-active circuit of a backlighting system (driven by LEDs) for a liquid-crystal display. The backlighting system for a liquid-crystal display of today employs either CCFLs (Cold-Cathode fluorescent lamps) or LEDs as its light source. As to the LEDs, some of the backlighting systems for liquid-crystal displays, which now has a wider gamut of colors, employ LEDs of RGB colors. Occurrence of shallow black expression is one of the drawbacks of liquid-crystal displays, and it is pointed out that liquid-crystal displays have a weakness in the expressions of the black gradation. A method known as the area-active control is one of the means for addressing the above-mentioned problem. In the area-active control, the backlighting system is divided into several blocks, and the amount of light emitted from the light source for each of the blocks thus divided is controlled in synchronization with the video signals. An area-active circuit employed in the LED driving device of the present invention is capable of linearly changing the amount of emitted light, so that a wider dynamic range of the amount of emitted light can be obtained.

Figure 6:
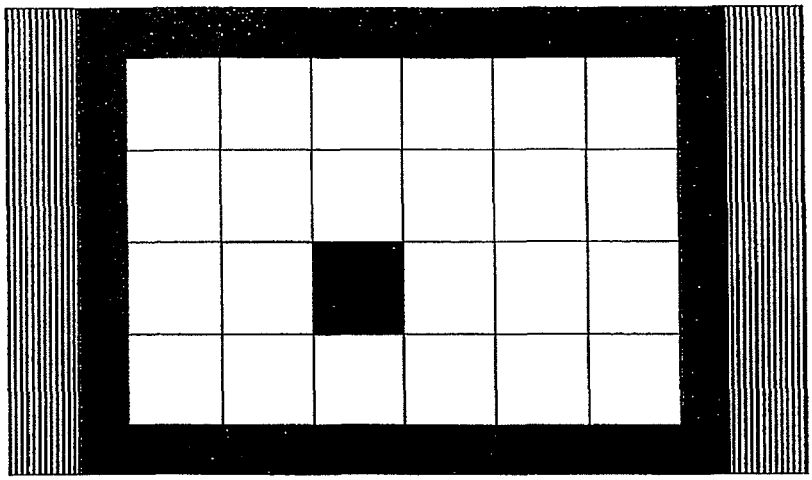
FIG. 6 is a diagram illustrating a state of a backlighting system of a liquid-crystal television set equipped with the LED driving device of the present invention.

FIG. 6 is a diagram illustrating a state of a backlighting system of a liquid-crystal television equipped with the LED driving device of the present invention. The LEDs provided in the backlighting system are grouped into blocks, and the brightness of the LEDs in each block is changed in accordance with the information on the intensity of the video image to be displayed. In this way, the problem of the shallow black expression, which is one of the drawbacks of liquid-crystal television, is improved.

Figure 7:
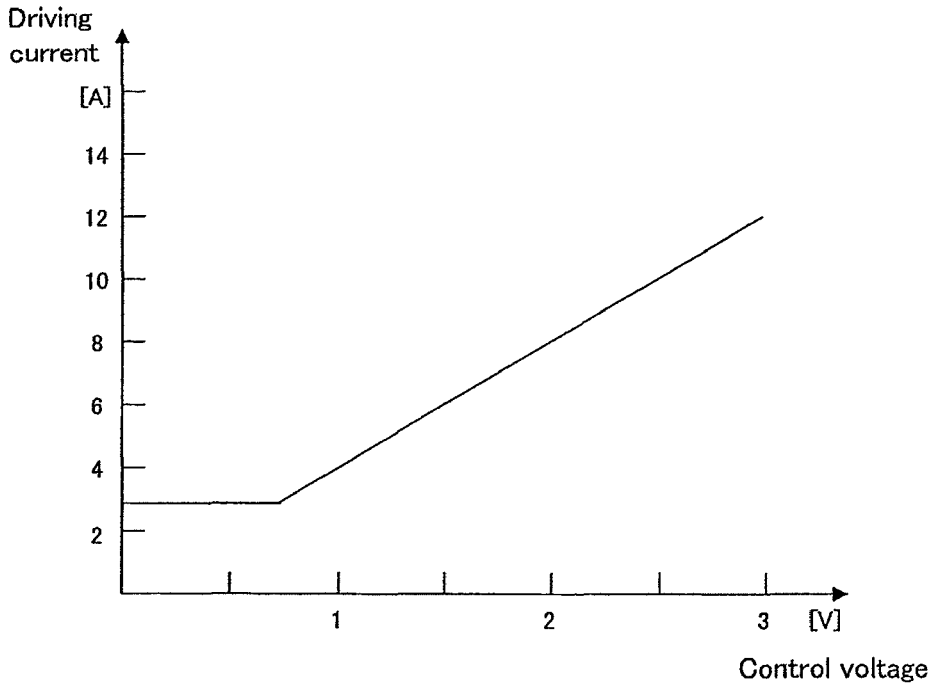
PRIOR ART FIG. 7
FIG. 7 is a graph illustrating typical characteristics of the conventional LED driving device shown in FIG. 4.
Figure 8:
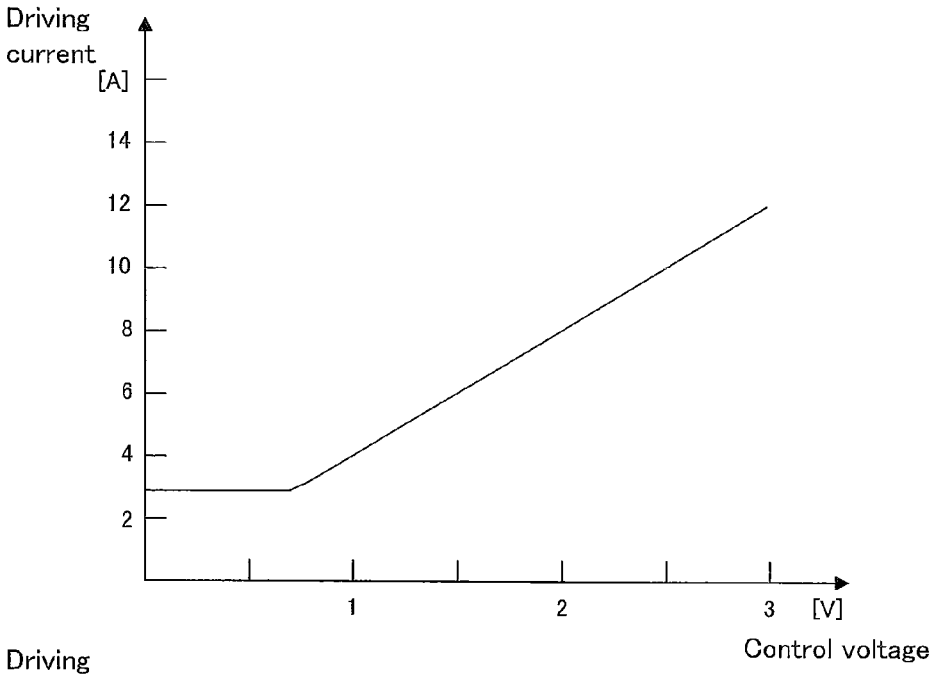
FIG. 8 shows graphs each of which illustrates typical characteristics of the LED driving device of the present invention shown in FIG. 5.
Figure 8:
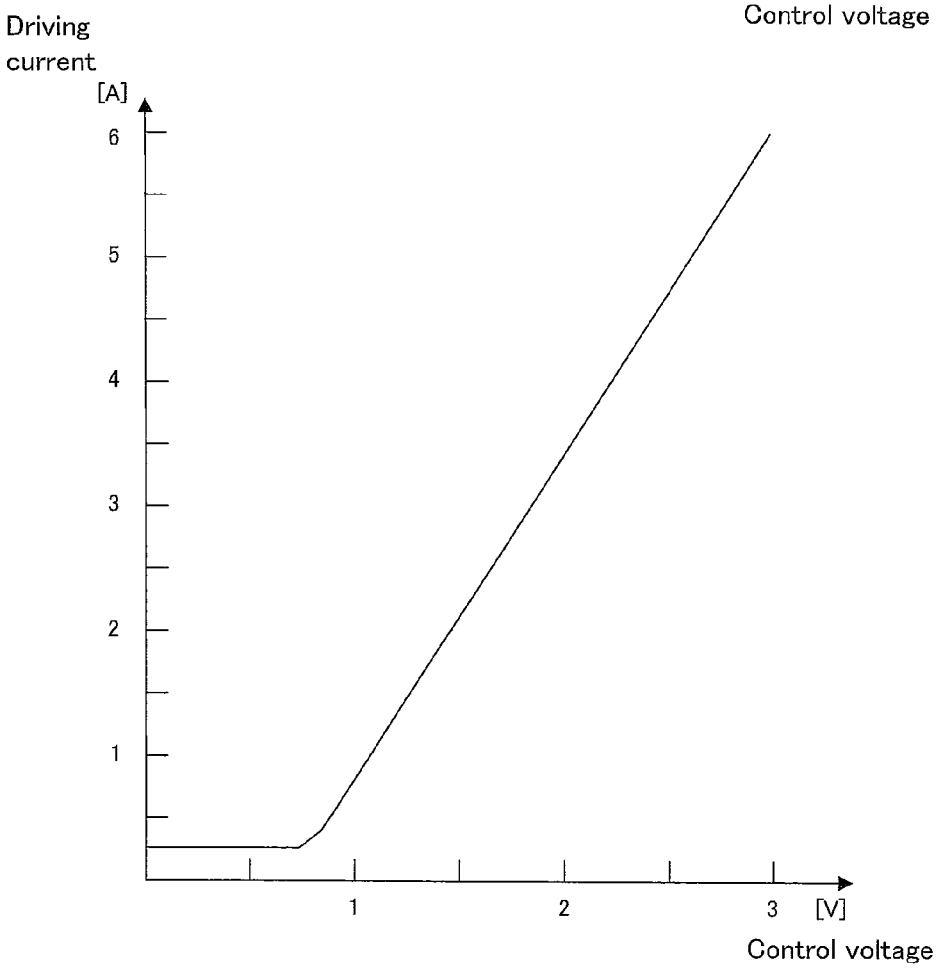
Figure 9:
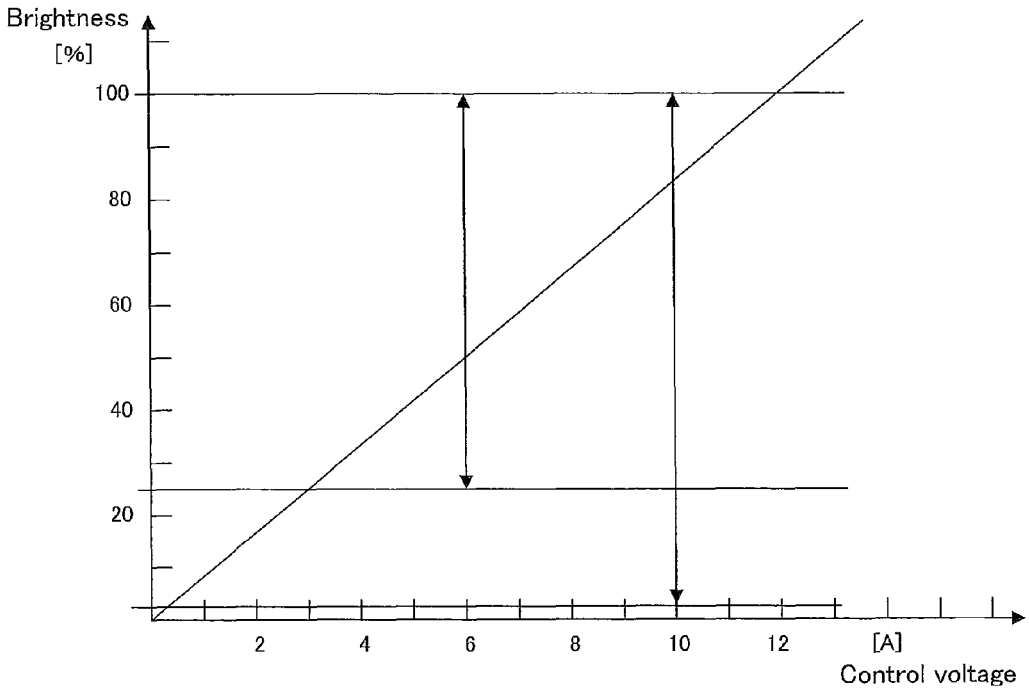
FIG. 9 is a graph illustrating the relationship between the light brightness of an LED and the current flowing through the LED.

FIG. 7 illustrates typical characteristics of the conventional LED driving device shown in FIG. 4. The horizontal axis represents the voltage to control the current, and the vertical axis represents the current flowing through the LEDs. FIG. 8 illustrates typical characteristics of the LED driving device of the present invention shown in FIG. 5. As in the case of FIG. 7, the horizontal axis represents the voltage to control the current, and the vertical axis represents the current flowing through the LEDs. As FIG. 8 shows, the LED driving circuit of the present invention has characteristics associated with two different modes. The controlling of a wide-range current flowing through the LEDs is accomplished by switching these modes (with the ND terminal in FIG. 5). Accordingly, the relationship between the brightness of the LEDs and the current flowing through the LEDs are determined as FIG. 9 shows. Thereby, the LED driving device of the present invention enables a significantly wider dynamic range. As a consequence, the backlighting system of a liquid crystal television equipped with the LED driving device of the present invention can have an effect of improving the above-mentioned shallow black expression.

When the conventional LED driving device shown in FIG. 4 is used in the backlighting system of a direct-view type display device, the LED driving device is formed as a circuit without the transistor Q1010. This LED driving device is designed with such specifications that the amount of light emitted from the LEDs can be changed between two different levels by changing the current flowing through the LEDs between two different levels. Accordingly, the LED driving device can be used by switching the control range of the DAC between two different levels.

Reference numerals R1001 to R1015 denote resistors, and reference numerals Q1001 to Q1010 denote transistors. LED_VCC shown in the upper right-hand portion of FIG. 4 denotes a power source to drive the LEDs with a large electric power. LED_GND denotes a ground for the power source. Connectors connected to a microcomputer and to a DAC are shown in the lower right-hand portion of FIG. 4. VCC+3.3V denotes a 3.3−V power source for a control circuit. LED ON denotes a signal that is high when the backlight is lit. GND denotes a reference ground of the circuit. DAC IN denotes a variable value ranging basically from the GND level to the VCC level. This signal allows the current flowing through the LEDs to be changed.

The portion enclosed by the dotted lines in FIG. 4 is a regulator unit. The LED driving device shown in FIG. 4 employs a series-regulator configuration. Nonetheless, with a switching-regulator configuration, the concept with respect to the feedback is still the same.

The driving voltage for the LEDs denoted by the LED ON switches the transistor Q1008 by means of the transistor Q1009 (the transistor Q1010 is not mounted on the circuit). The transistor Q1003 is provided for the regulation of the driving voltage thus switched.

In the LED driving device shown in FIG. 4, the transistors Q1002 and Q1004 constitute a differential circuit. The transistors Q1001 and Q1005 constitute an interface circuit for inputting a signal into the differential circuit. The current having flowed through the LEDs flows through a resistor network including the resistors R1001 and R1002. When the current having flowed through the LEDs flows through the resistor network, a voltage is generated between the GND of the resistor network and the cathodes of the LEDs. The voltage thus generated passes through the transistor Q1001 and returns to the transistor Q1002. The differential circuit including the transistors Q1002 and Q1004 controls the base current of the transistor Q1003 so that the voltage applied to the base of the transistor Q1004 can be the same as the base voltage of the transistor Q1002. Accordingly, the potential applied to the resistor network including the resistors R1001 and R1002 changes in accordance with the change in the DACIN, and the current flowing through the LEDs changes in response directly to the video image.

The control of a minute current, however, is difficult by use of the above-described system which controls the current in a feedback route in which a current-voltage conversion is performed. Even when the base potential of the transistor Q1005 is set to zero, the occurrence of a dark current (leakage current) prevents the transistor Q1001 from having a zero base voltage. In this case, it is difficult to reduce the light amount.

Figure 10:
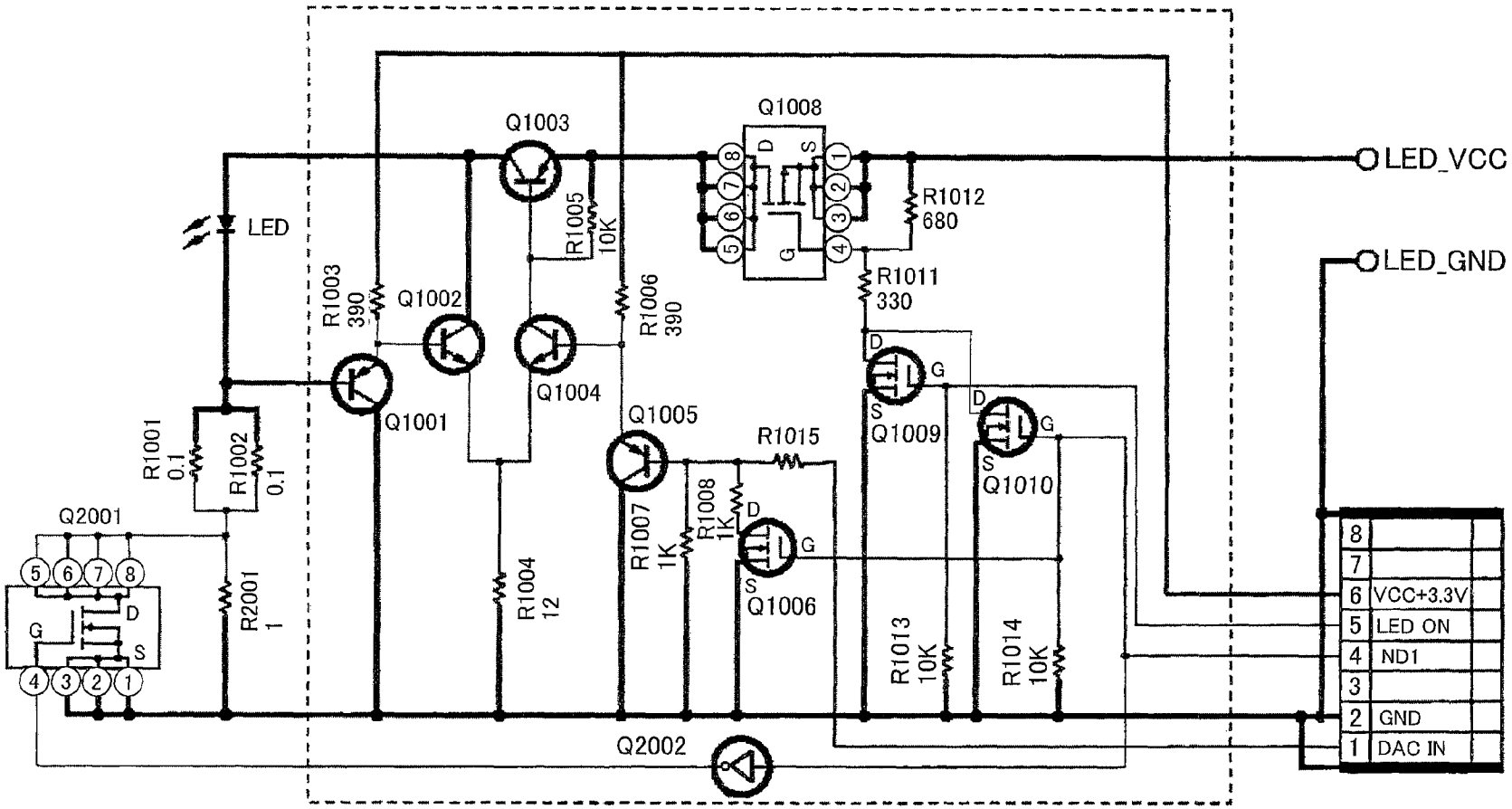
FIG. 10 is a circuit diagram illustrating an LED driving circuit of the present invention (for a reflection-type display device).

FIG. 10 is a circuit diagram illustrating a circuit of the LED driving device of the present invention. Reference numerals R1001 to R1015, and R2001 denote resistors. Reference numerals Q1001 to Q1010, and Q2001 denote transistors. LED_VCC shown in the upper right-hand portion of FIG. 10 denotes a power source to drive the LEDs with a large electric power. LED_GND denotes a ground for the power source. Connectors connected to a microcomputer and to a DAC are shown in the lower right-hand portion of FIG. 10. VCC+3.3V denotes a 3.3–V power source for a control circuit.

LED ON denotes a signal that is high when the backlight is lit. GND denotes a reference ground of the circuit. DAC IN denotes a variable value ranging basically from the GND level to the VCC level. This signal allows the current flowing through the LED to be changed.

The portion enclosed by the dotted lines in FIG. 10 is a regulator unit. The LED driving device shown in FIG. 10 also employs a series-regulator configuration. Nonetheless, with a switching-regulator configuration, the concept with respect to the feedback is still the same.

The driving voltage for the LEDs denoted by the LED ON switches the transistor Q1008 by means of the transistor Q1009 (the transistor Q1010 is not mounted on the circuit). The transistor Q1003 is provided for the regulation of the driving voltage thus switched.

In the LED driving device shown in FIG. 10, the transistors Q1002 and Q1004 constitute a differential circuit. The transistors Q1001 and Q1005 constitute an interface circuit for inputting a signal into the differential circuit. The current having flowed through the LEDs flows through a resistor network including the resistors R1001, R1002, and R2001. When the current having flowed through the LEDs flows through the resistor network, a voltage is generated between the GND of the resistor network and the cathodes of the LEDs. The voltage thus generated passes through the transistor Q1001 and returns to the transistor Q1002. The differential circuit including the transistors Q1002 and Q1004 controls the base current of the transistor Q1003 so that the voltage applied to the base of the transistor Q1004 can be the same as the base voltage of the transistor Q1002. Accordingly, the potential applied to the resistor network including the resistors R1001 and R1002 changes in accordance with the change in the DACIN, and the current flowing through the LEDs changes in response directly to the video image.

The control of a minute current, however, is difficult by use of the above-described system which controls the current in a feedback route in which a current-voltage conversion is performed. Even when the base potential of the transistor Q1005 is set to zero, the occurrence of a dark current (leakage current) prevents the transistor Q1001 from having a zero base voltage.

As will be described below, in the LED driving device of the present invention shown in FIG. 10, the value of the current flowing through the feedback route is switched by the transistor Q2001 in accordance with the driving current of the LEDs so that the driving current is reduced except for the case of the emission of the normal light. What is made possible with this configuration is the controlling of a minute current, which is not possible with the conventional feedback configuration as shown in FIG. 4.

The gate of the transistor Q2001 is controlled by the inversion signal of the ND. When the LEDs do not emit the ND light, the transistor Q2001 is in operation and, in the circuit, the resistor R2001 is made to be equivalent to the ground. Accordingly, in this case, the current flowing through the LEDs is determined by the value of the combined resistor including the two resistors R1001 and R1002.

When the LEDs emit the ND light, that is, when the gate voltage of the transistor Q2001 is low, the transistor Q2001 is not in operation, so that the circuit as a whole becomes equivalent to a circuit without the Q2001. Accordingly, in this case, the current flowing through the LEDs is determined by the value of the combined resistor including the three resistors R1001, R1002, and R2001.

As has been described above, in the LED driving device of the present invention, the current is controlled by the video image applied to the DACIN, and the value of the current is switched by the feedback route. Accordingly, a minute current can be controlled. The use of the LED driving device of the present invention in a direct-view type display device can result in the effect obtainable by the conventional light modulation method with the pulse light emission. As a consequence, a reduction in the switching noise is possible.

In the above-described embodiment, a second case has been described using an example of a liquid-crystal display system equipped with a backlighting system including a LED light source. The present invention, however, is not limited to the above-described embodiment, but is applicable to other uses. For example, the present invention can be carried out as an illuminating device equipped with a light source of LED and as a device enabling the adjustment of the amount of light.

The LED driving device of the present invention can also be used as a driving device for LEDs used in a display device. Conventionally, LEDs have been used in the displays of electric signboard and the like for expressing simple characters and the like. Some of these electric signboards used in pachinko parlors and the like express animation and the like, but the quality of the video image has not reached a level equivalent to liquid-crystal displays.

With the LED driving device of the present invention, the driving current for LEDs to be driven can be changed dynamically. Accordingly, the use of the LED driving device of the present invention allows not only the expression of colors achieved conventionally by the simple combination of the ON/OFF of the RGB colors but also the expression of a wider variety of colors.

As described above with reference to FIG. 8, each of the LED driving devices of the present invention shown in FIGS. 5 and 10 has the characteristics associated with two different modes. The LED driving devices of the present invention switches these two modes, and thereby controls a wider-range current flowing through the LEDs. Accordingly, the relationship between the brightness of the LEDs and the current flowing through the LEDs is determined as shown in FIG. 9, so that a significantly wider dynamic range can be achieved by use of the LED driving device of the present invention. What is made possible accordingly is a control appropriate for the light-intensity variation that is necessary for the signal of a video image divided into the RGB colors. Thereby, a wider variety of colors can be expressed by individually changing the brightness of the RGB colors.

Figure 11:
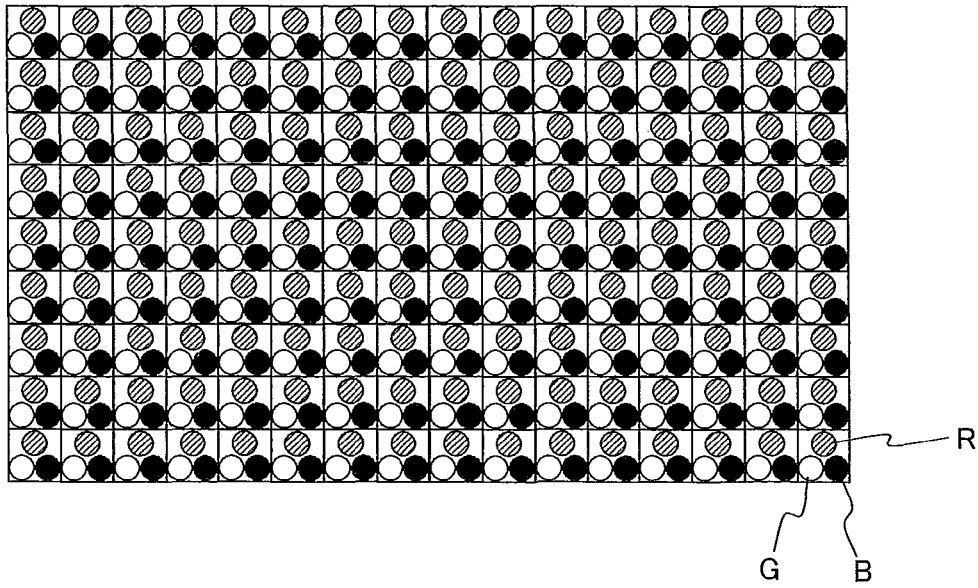
FIG. 11 is a schematic diagram illustrating the concept of an LED display device employing the LED driving device of the present invention.

FIG. 11 is a diagram illustrating the concept of an LED display device employing the LED driving device of the present invention. The LED display device includes multiple packages of LEDs while a single package includes a red LED, a green LED, and a blue LED, and the LEDs are driven individually by the LED driving device of the present invention. What is achieved accordingly is an expression of fine light-intensity differences.

INDUSTRIAL APPLICABILITY

The present invention is applicable to an LED driving device.

The invention claimed is:

1. An LED driving device, comprising:

a driving voltage switching means for switching between a first driving voltage for emitting normal light and a second driving voltage for emitting neutral density light in accordance with a timing signal; and a feedback circuit to which any one of the first and second driving voltages is applied and which thereby determines a current flowing through an LED, wherein the feedback circuit includes, a resistor network including a first resistor and a second resistor connected in series, the first resistor being provided between the LED and the second resistor, and a current controlling means for controlling the current flowing through the LED to bypass the second resistor when the first driving voltage is being applied.

2. The LED driving device according to claim 1, wherein the current controlling means is a resistor switching means for switching, in accordance with the timing signal, the second resistor that determines the current flowing through the LED.

3. An illuminating device, comprising:

an LED driving device according to claim 1; and an LED driven by the LED driving device.

4. A display device, comprising:

an LED driving device according to claim 1;

a green LED, a red LED and a blue LED which are driven by the LED driving device;

a controlling means for switching between the green LED, the red LED and the blue LED, and making the selected one of the LEDs emit light;

a reflective device which is controlled by the controlling means in synchronization with the light emission of the green LED, the red LED, and the blue RGB, and which modulates the light emitted by the green LED, the red LED, and the blue RGB; and a projection optical system which projects light reflected by the reflective device.

5. A direct-view type display device, comprising:

an LED driving device according to claim 1;

a controlling means for switching a driving current for an LED driven by the LED driving device, and then for making the LED emit light; and a backlighting system, wherein the LED driving device, the controlling means and the backlighting system are combined to enable an area-active control.

6. The LED driving device according to claim 1, wherein the current is determined only by the first resistor, and controlling the current not to bypass the second resistor when the second driving voltage is being applied, such that the current is determined by the first resistor and the second resistor.

7. An illuminating device, comprising:

an LED driving device according to claim 6; and an LED driven by the LED driving device.

8. A display device, comprising:

an LED driving device according to claim 6;

a green LED, a red LED and a blue LED which are driven by the LED driving device;

a controlling means for switching between the green LED, the red LED and the blue LED, and making the selected one of the LEDs emit light;

a reflective device which is controlled by the controlling means in synchronization with the light emission of the green LED, the red LED, and the blue RGB, and which modulates the light emitted by the green LED, the red LED, and the blue RGB; and a projection optical system which projects light reflected by the reflective device.

9. A direct-view type display device, comprising:

an LED driving device according to claim 6;

a controlling means for switching a driving current for an LED driven by the LED driving device, and then for making the LED emit light; and a backlighting system, wherein the LED driving device, the controlling means and the backlighting system are combined to enable an area-active control.

* * * * *